US006708488B2

(12) United States Patent
Büter

(10) Patent No.: US 6,708,488 B2
(45) Date of Patent: Mar. 23, 2004

(54) EXHAUST SYSTEM FOR AN INTERNAL COMBUSTION ENGINE

(75) Inventor: Hermann Büter, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 96 days.

(21) Appl. No.: 10/131,809

(22) Filed: Apr. 19, 2002

(65) Prior Publication Data

US 2002/0178717 A1 Dec. 5, 2002

(30) Foreign Application Priority Data

May 3, 2001 (DE) ..... 101 21 498

(51) Int. Cl.[7] ..... F01N 7/10
(52) U.S. Cl. ..... 60/323; 60/278
(58) Field of Search ..... 60/278, 313, 321, 60/323

(56) References Cited

U.S. PATENT DOCUMENTS 4,041,700 A 8/1977 Okamoto
4,147,031 A 4/1979 Tanuma et al.

FOREIGN PATENT DOCUMENTS

DE 199 09 034 1/2001

*Primary Examiner*—Thomas Denion
*Assistant Examiner*—Diem T Tran
(74) *Attorney, Agent, or Firm*—Klaus J. Bach

(57) ABSTRACT

In an exhaust system for an internal combustion engine, having an exhaust manifold including an inner shell and an outer shell partially surrounding the inner shell, so that the space between the shells forms an insulating volume, an exhaust gas recirculation line is connected to the outer shell of the exhaust manifold for removal of exhaust gas for its recirculating from the space between the inner and outer shells. The invention is also directed to a method for recirculating exhaust gas.

2 Claims, 1 Drawing Sheet

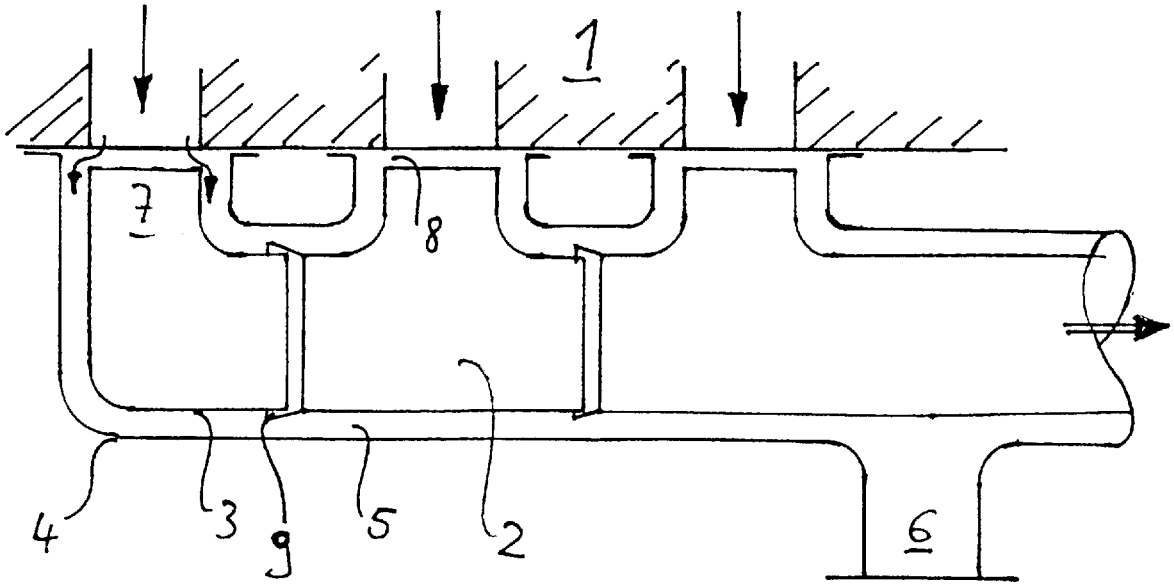
1
7
8
4
3
9
5
2
6

EXHAUST SYSTEM FOR AN INTERNAL COMBUSTION ENGINE

BACKGROUND OF THE INVENTION

The invention relates to an exhaust system for an internal combustion engine including spaced inner and outer shells forming an insulating gap therebetween and also to a method for re-circulating exhaust gas to the engine.

The patent DE 199 09 934 C1 discloses an air gap-insulated exhaust manifold for an internal combustion engine, which is designed with an inner pipe which carries exhaust gases and an outer shell which surrounds the inner pipe at a distance therefrom so as to form an air gap. This air gap insulated exhaust manifold has a connection for an exhaust gas recirculation line, which is secured to the inner pipe at one end of the exhaust manifold in such a manner that the exhaust gas which is to be re-circulated is removed from the main exhaust gas stream in the inner pipe.

It is an object of the invention to provide an element system and a method of recirculating exhaust gas at a relatively low temperature.

SUMMARY OF THE INVENTION

In an exhaust system for an internal combustion engine having an exhaust manifold including an inner shell and an outer shell partially surrounding the inner shell, so that the space between the shells forms an insulating volume, an exhaust gas recirculation line is connected to the outer shell of the exhaust manifold for removal of exhaust gas for its recirculation from the space between the inner and outer shells. The invention is also directed to a method for recirculating exhaust gas.

The exhaust system according to the invention for an internal combustion engine has an air gap insulated exhaust manifold and/or an air gap insulated exhaust pipe. An air gap insulation of this type is achieved by means of an inner shell or pipe, through which the hot exhaust gas is passed, and an outer shell which is arranged at a distance from the inner shell and provides a supporting function for the inner shell. An insulating volume, in the form of the insulating air gap, is formed between the inner shell and the outer shell. The inner shell is preferably of multi-part design, since in operation it becomes considerably hotter than the outer shell, which is cooled by the surrounding air by convection. To avoid thermal stresses, the individual parts of the inner shell can move with respect to one another. An absolute seal is not necessary in conventional air gap insulated exhaust systems, since the outer shell always provides a seal with respect to the environment. For production reasons, the outer shell is of two-part or multi-part design. In exhaust manifolds or exhaust pipes according to the invention, the inner shell is advantageously provided with one or more gas passages leading to the space between inner and outer shells, i.e. the insulating volume. The gas passages are advantageously arranged at the front end of the inner shell, as seen in the direction of flow. The connection element for removing exhaust gas for exhaust gas recirculation from the space between inner shell and outer shell is arranged on the outer shell, preferably at the rear end of the outer shell as seen in the direction of flow.

As a result of exhaust gas which is to be recirculated flowing into the air gap-insulated exhaust manifold or the exhaust pipe at the opposite end of the connection element, as seen in the direction of flow, the exhaust gas which is to be recirculated flows through the entire insulating space and prevents excessive dissipation of heat from the main flow of the exhaust gas to the environment while simultaneously releasing heat to the environment via the outer shell.

At the same time, the exhaust gas, which is to be recirculated, is cooled at the outer shell, and consequently, a separate exhaust cooler is no longer required, or a smaller design of the exhaust cooler is sufficient. To achieve its full effect with regard to $NO_x$ reduction, the exhaust gas which is to be recirculated should be as cool as possible when it enters the engine. A further advantage is the reduced amount of space taken up by an air gap insulated exhaust manifold in combination with integrated exhaust gas recirculation and exhaust cooling.

It is advantageous for the connection element to be fitted to the outer shell in the form of a connection piece or a flange. As a result, it is easily possible to connect an exhaust gas recirculation line to the exhaust manifold or the exhaust pipe.

The outer shell preferably comprises a plurality of individual sheet-metal parts. When producing the sheet-metal parts for the outer shell, it is an inexpensive and operationally reliable solution to form a section of the outer shell and the connection stub integrally.

The method according to the invention is distinguished by the fact that the exhaust gas for exhaust gas recirculation is removed from the insulating volume via a connection element and is fed to the internal combustion engine via a second exhaust pipe. It is advantageous for the exhaust gas, which is to be recirculated, with respect to the exhaust gas stream, to be removed from the exhaust gas stream near the upstream end of the gas stream. Therefore, the exhaust gas flows in the insulating volume initially parallel to the exhaust gas stream, is removed at the downstream end of the insulating volume, with respect to the exhaust gas stream, and flows through the exhaust gas re-circulation line to the intake side of the internal combustion engine.

Further features and combinations of features will become apparent from the following description on the basis of the accompanying drawing.

BRIEF DESCRIPTION OF THE DRAWINGS

The sole FIGURE is a diagrammatic illustration of an air gap-insulated exhaust manifold having a connection element according to the invention between exhaust manifold and exhaust gas recirculation line.

DETAILED DESCRIPTION OF AN EXEMPLARY EMBODIMENT

The FIGURE illustrates a cylinder head 1 of an internal combustion engine (not shown in detail) with an exhaust manifold 2. The exhaust manifold 2 comprises a multi-part inner shell 3 and an outer shell 4. Between the inner shell 3 and the outer shell 4, there is an insulating volume, in the form of an air gap 5. A connection stub 6, which guides a partial stream of the exhaust gas to an exhaust gas recirculation line (not shown), is arranged on the outer shell 4. The inner shell 3 is held by support elements (not shown), such as for example sheet-metal straps or holders, of the outer shell 4, in such a manner that the insulating air gap 5 has approximately the same thickness over its entire periphery and length, but at the same time, the heat transfer from the inner shell to the outer shell is minimized.

The exhaust gas flows out of the cylinder head 1 mostly through the inner shell 3 to a flange (not shown), at which a further element of the exhaust installation is connected, for example an exhaust gas turbocharger, an exhaust pipe, a catalytic converter or a muffler.

The inner shell 3 is designed to be moveable, in such a manner that the individual sections of the inner shell can shift with respect to one another in order to compensate for considerable thermal expansion. The inner shell 3 is provided with gas passages 8 at the entry 7 of the gas into the exhaust manifold 2.

At the gas passages 8, a smaller partial stream of the exhaust gas flows into the air gap 5 and leaves the air gap, at the other end of the exhaust manifold 2, through the connection stub 6 to an exhaust gas recirculation line (not shown). From there, the exhaust gas is returned to the internal combustion engine on the intake side of the cylinder head 1. In addition, a small quantity of exhaust gas passes into the air gap 5 through the spaces 9 between the individual sections of the inner shell 3. The exhaust gas in the air gap 5 insulates the hot exhaust gas in the inner shell 3 so that excessive cooling thereof is prevented. Thermal insulation between the hot exhaust gas and the environment is also provided by the presence of two shells 4, 5.

The exhaust gas in the air gap 5 is cooled at the outer shell 4 where heat is transferred to the environment. As a result, the exhaust gas is already pre-cooled when it enters the exhaust gas recirculation line (not shown). This eliminates the need for an exhaust gas cooler, which cools the exhaust gas to a temperature which is suitable for the intake region of the internal combustion engine and for combustion. If an exhaust gas cooler is still required, it can be relatively. A smaller exhaust gas cooler or even the elimination of an exhaust gas cooler makes the exhaust gas recirculation system, in particular the exhaust gas recirculation line and the entire internal combustion engine, easier to fit and package.

What is claimed is:

1. An exhaust system for an internal combustion engine having an exhaust manifold including an inner shell and an outer shell partially surrounding the inner shell in spaced relationship, the space between said shells forming an insulating volume, said inner shell having entry areas and being supported such that said entry areas are disposed adjacent said engine in spaced relationship therefrom so as to permit exhaust gas from said engine to enter said outer shell while said inner shell is freely expandable relative to said engine and said outer shell, and an exhaust gas recirculation line connected to said exhaust manifold, said outer shell including a connection stub arranged near the downstream end of said outer shell with respect to the exhaust gas stream in the exhaust manifold for removing exhaust gas from said space between said inner and outer shells for recirculating said exhaust gas through said recirculation line to the engine.

2. An exhaust system according to claim 1, wherein said connection stub and said outer shell are formed integrally.

* * * * *